United States Patent [19]

Ortiz

[11] Patent Number: 4,596,222

[45] Date of Patent: Jun. 24, 1986

[54] VOLTAGE REGENERATOR FOR IGNITION SYSTEMS OF INTERNAL COMBUSTION ENGINES

[75] Inventor: Jose M. Ortiz, Mexico City, Mexico

[73] Assignee: Coil Booster, Inc., Houston, Tex.

[21] Appl. No.: 729,679

[22] Filed: May 2, 1985

[51] Int. Cl.[4] ..... F02M 27/04; F02P 15/00

[52] U.S. Cl. ..... 123/536; 123/620

[58] Field of Search ..... 123/536, 620, 654, 656

[56] References Cited

U.S. PATENT DOCUMENTS

| | | | |
|---|---|---|---|
| 2,451,482 | 10/1948 | Flint | 123/536 X |
| 3,019,276 | 1/1962 | Harlow | 123/536 X |
| 3,613,653 | 10/1971 | Irvin, Jr. et al. | 123/536 X |
| 3,949,718 | 4/1976 | Turner | 123/536 |
| 4,269,160 | 5/1981 | Irvin, Jr. | 123/620 |
| 4,324,219 | 4/1982 | Hayashi | 123/620 |

*Primary Examiner*—Tony M. Argenbright
*Attorney, Agent, or Firm*—McGlew and Tuttle

[57] ABSTRACT

The voltage lost through the formation of magnetic fields and leakage and stray currents on the cover of a distributor and on the insulation of the high-voltage current conducting cables from a high-voltage coil to a distributor and from a distributor to a plurality of spark plugs of an ignition system of an internal combustion engine is at least partially regenerated by a voltage regenerator comprising inductive current trapping means for recovering the current lost through the insulation of said high-voltage current conducting cables, said current trapping means being coupled to said cables at a short distance from the current receiving ends thereof; encapsulated current collector means for receiving the current recovered by said current trapping means; at least some of said current trapping means including unidirectional current flow means permitting only the flow of current toward said collector means; current attracting means inductively coupled to said collector means; and inductive current delivery means for delivering the recovered current from said collector means to said high-voltage conducting cable running from the high-voltage coil to the distributor, said current delivery means being coupled to said cable at a short distance from the current discharge end thereof and including unidirectional current flow means permitting only the flow of current from said collector means to said last named cable.

7 Claims, 3 Drawing Figures

VOLTAGE REGENERATOR FOR IGNITION SYSTEMS OF INTERNAL COMBUSTION ENGINES

FIELD OF THE INVENTION

The present invention refers to the regeneration of the voltage produced by a high-voltage coil in an ignition system for internal combustion engines and, more particularly, it is related to a voltage regenerator for ignition systems of internal combustion engines, which is capable of recovering most of the current normally lost through leakage and stray currents as well as through magnetic fields in said ignition system.

BACKGROUND OF THE INVENTION

As it is well known, the ignition system of internal combustion engines generally comprises a high-voltage coil which delivers through a suitable cable to a distributor, a current of from 20,000 to 22,000 volts, which is thereafter transmitted to the brush of the distributor in order to sequentially send said current to each one of the spark plugs inserted in the cylinders of the engine, in order to ignite the same in the order in which the engine is designed, for effecting the combustion of the fuel which is fed to the machine through a suitable carburator. As it is also well known, the said voltage of 20,000 to 22,000 volts produced by said coil, is generally reduced down to approximately 16,000 to 18,000 volts when the current reaches the spark plugs, whereby the spark produced by said spark plugs is imperfect and creates a lower temperature of ignition of the fuel, thereby causing the internal combustion of the fuel in the cylinders of the engine to be incomplete. Due to the relatively lower temperature of operation of the spark plugs, the electrodes of said spark plugs build up a thick scale of lead and carbon, whereby the spark plugs gradually produce a more deficient operation and a higher consumption of fuel.

Although some attempts have been made in the past in order to maintain the voltage reaching the spark plugs from the high-voltage coil of an ignition system of an internal combustion engine, such as by providing connecting cables of a higher capacity of conduction, or by supplying said cables with terminal ferrules or blocks of more efficiently conducting materials such as graphite or quartz, the problem of loss of voltage in the cables has not been solved by these devices, because most of the voltage is lost through the formation of magnetic fields and leakage and stray currents on the cover of the distributor of the internal combustion engine, and through and on the insulation of the high-voltage current conducting cables running from the high-voltage coil to the distributor and from the latter to the plurality of spark plugs located in the cylinders of the engine. In other words, although the terminal blocks or ferrules or plugs of good conducting materials have improved the efficiency of conduction of the high-voltage cables, the main problem of loss of voltage through said magnetic fields and leakage and stray currents cannot be solved in this manner, whereby this type of devices, while in use, do not provide a reasonable solution to this problem.

One other type of devices that have been introduced in the ignition systems of internal combustion engines to reduce the voltage loss, mainly the voltage loss due to magnetic fields created on the cover of the distributor, comprises the provision of highly complicated magnetic devices on the said cover or head of the distributor of the ignition system of an internal combustion engine, with which the magnetic fields created at said place of the ignition system, which are the cause of a part of the loss of voltage from the high-voltage coil of the ignition system, may be partially recovered by inducing a current which is reapplied to the distributor, but these devices are so complicated and so prone to be spoiled, that the same have not acquired any reasonable popularity in the existent market.

The disadvantages shown by the prior art devices described above, which were intended to improve the conduction of high-voltage current through the cables and devices of an ignition system of internal combustion engines, are caused by the fact that said devices have not attacked the main problem of loss of voltage in said ignition system, but have rather restricted themselves to try to increase the conductivity of the cables, the conductivity of the terminal ends of said cables or the neutralization of the magnetic fields created on the distributor head, without however trying to recover the current lost both through the head of the distributor and through the insulation of the high-voltage current conducting cables from the high-voltage coil to the distributor and from the latter to the spark plugs which are inserted in the cylinders of the engine.

Therefore, it has been for long sought to provide a voltage regenerator device that may recover the current lost by the above described means, in order to feed the recovered current again to the ignition system, whereby said otherwise lost current be recycled into the ignition system, thereby minimizing the voltage loss and improving the spark of the spark plug and therefore the ignition of the fuel, without however such a satisfactory device having been provided as is shown considering those extant in the prior art.

OBJECTS OF THE INVENTION

Having in mind the defects of the prior art devices for improving the conduction of current in an ignition system for internal combustion engines, it is an object of the present invention to provide a voltage regenerator for ignition systems of internal combustion engines that may be of a very simple construction and yet of a high efficiency in recovering the current lost through magnetic fields and leakage and stray currents through the insulation of the high-voltage current conducting cables.

It is another object of the present invention to provide a voltage regenerator of the above described character, which will be capable of recovering the current lost through the insulation of the various high-voltage current conducting cables and other devices of the ignition system of an internal combustion engine, to recycle said recovered current into the ignition system in order to minimize the losses.

It is a more particular object of the present invention to provide a voltage regenerator of the above described character, which will produce an efficient spark discharge in the spark plugs of an internal combustion engine, without however requiring any increase in the high-voltage current from the coil.

It is one other object of the present invention to provide a voltage regenerator of the above identified nature, which will be of a very compact and sturdy construction and will show characteristics of easy installation without any modification in the standard ignition systems of internal combustion engines.

The foregoing objects and others ancillary thereto are preferably accomplished as follows.

According to a preferred embodiment of the present invention, the voltage lost through the formation of magnetic fields and leakage and stray current on the cover of a distributor and on the insulation of the high-voltage current conducting cables from a high-voltage coil to a distributor and from a distributor to a plurality of spark plugs of an ignition system of an internal combustion engine is partially regenerated by the provision of a voltage regenerator in accordance with the present invention, which comprises inductive current trapping means for recovering the current lost through the insulation of said high-voltage current conducting cables, said current trapping means being coupled to said cables at a short distance from the current receiving ends thereof; encapsulated current collector means for receiving the current recovered by said current trapping means; at least some of said current trapping means including unidirectional current flow means permitting only the flow of current toward said collector means; current attracting means inductively coupled to said collector means; and inductive current delivery means for delivering the recovered current from said collector means to said high-voltage conducting cable running from the high-voltage coil to the distributor, said current delivery means being coupled to said cable at a short distance from the current discharge end thereof and including unidirectional current flow means permitting only the flow of current from said collector means to said last named cable.

BRIEF DESCRIPTION OF THE DRAWINGS

The novel features that are considered characteristic of the present invention are set forth with particularity in the appended claims. The invention itself, however, both as to its organization and its method of operation, together with additional objects and advantages thereof, will best be understood from the following description of a specific embodiment, when read in connection with the accompanying drawings, in which:

DETAILED DESCRIPTION

Figure 1:
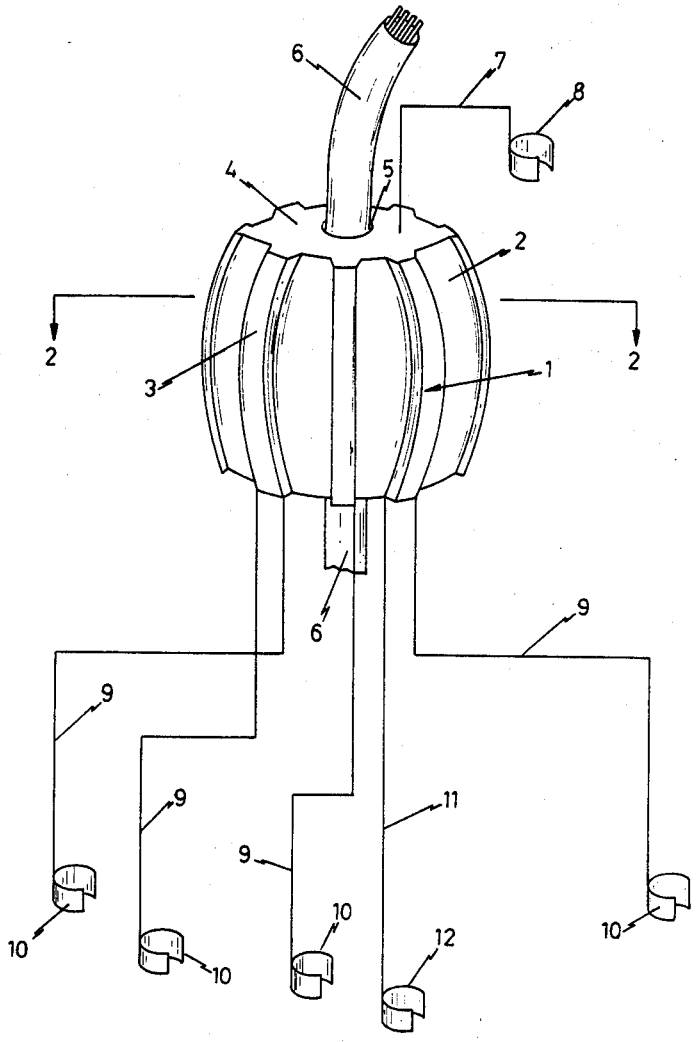
FIG. 1 is a partially diagrammatical view of the voltage regenerator for ignition systems of internal combustion engines built in accordance with the present invention and showing the mounting thereof around the high-voltage conducting cable from the coil to the distributor.

Having now more particular reference to the drawings and more specifically to FIG. 1 of the same, there is shown a voltage regenerator device suitable for being coupled to an ignition system of an internal combustion engine and which comprises an encapsulating body which is designated by means of reference character 1, said body having a form suitable to encapsulate all the main portions of the circuit for the voltage regenerator built in accordance with the present invention and normally consisting of a body of any suitable plastic material such as polyester, polycarbonate and the like, capable of resisting the high-voltages and high temperatures to which it will be subjected in use. The body 1 normally comprises a curved cylinder 2 which has a plurality of external ribs 3 to assist in the dissipation of heat and in the housing of the various elements of the circuit which are embedded thereinto, and has a pair of flat ends 4 such as that shown in FIG. 1 of the drawings, at the center of which a through bore 5 is provided, for the purpose of mounting the body 1 around the high-voltage current conducting cable 6 which connects the outlet of the high-voltage coil of the ignition system of the engine to the head or cover of the distributor and which is designated by means of reference character 6 in FIG. 1 of the drawings.

A clamp 8 built of a good conducting material such as copper, silver or the like, is pressed or crimped around the insulation of cable 6 at a short distance from the outlet of the high-voltage coil of the ignition system of the internal combustion engine, and said clamp is thereafter insulated by means of a suitable insulating tape, in order to avoid any possibility of contact with the conducting material of the clamp 8 or loss of voltage by eddy currents and the like. Clamp 8 is connected to the circuit of the voltage regenerator built in accordance with the present invention and which will be described in detail hereinafter, by means of a suitably insulated cable 7, preferably a cable having a plastic lining and covered with a fiber glass fabric wrapped around said plastic insulation, in order to duly conduct the current that is transmitted to the clamp 8 by induction through the insulation of cable 6, into the circuit which will be described hereinbelow.

From the opposite flat face 4 of the body 1 of the voltage regenerator built in accordance with the present invention, a plurality of cables 9 extend, said cables being built in exactly the same manner as cable 7 described above, in order to conduct current into the circuit of the voltage regenerator as will be described hereinbelow and which is entirely embedded within body 1, said current being conducted from the respective clamps 10, similar to clamp 8, each one of which is crimped around the insulation of each one of the high-voltage conducting cables conducting current from the head of the distributor to the spark plugs that are inserted in the cylinders of the internal combustion engine with which the ignition system is associated. The mounting of clamps 10 around the insulation of the cables from the distributor to the spark plugs is effected at a short distance from the distributor head, and said clamps, after having been crimped around the insulation of said cables, are suitably insulated by means of a plastic tape or the like.

Finally, a further cable 11 extends from the lower face 4 of the body 1 as shown in FIG. 1 of the drawings, in order to conduct current in the opposite way, namely, from the circuit embedded in body 1 and to be described in detail hereinbelow, towards a further clamp 12 similar to the clamps described above, which is crimped around the insulation of cable 6, but mounted at a short distance from the head of the distributor, in order to conduct the current recovered by the device of the present invention, through cable 11 and clamp 12, to be applied around the insulation of cable 6 at the point indentified above, in order to inductively pass said current into cable 6 and to the distributor, in the form of a recycled current which is therefore recovered rather than completely lost. The mounting of clamp 12 is effected exactly in the same manner described above, that is, by crimping said clamp around the insulation of cable 6 near the end of cable 6 which is connected to the head of the distributor, and by insulating said clamp by means of a suitable plastic tape or the like.

Having now more particular reference to FIGS. 2 and 3 of the drawings, the arrangement and the details of the circuit of the voltage regenerator built in accordance with the present invention and suitable for being coupled to an ignition system of an internal combustion engine are clearly shown as will be described hereinbelow. The same reference numerals are used to identify like parts as compared to those of FIG. 1 already described above.

Figure 2:
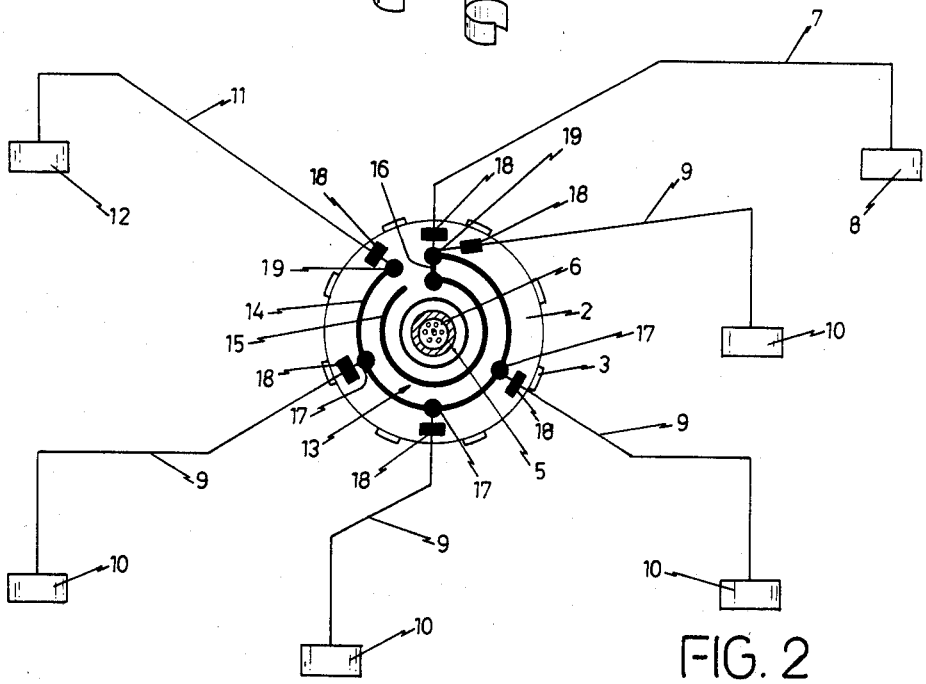
FIG. 2 is a diagrammatical cross sectional view taken along lines 2—2 of FIG. 1 and looking in the direction of the arrows.

FIG. 2 of the drawings shows a cross sectional diagrammatic view of the device shown in FIG. 1 and described above in connection with its essential parts, wherein the structure of the inner circuit embedded in the body 1 of the device of the present invention is clearly shown as comprising a pair of incomplete circumferencial conductors of either wire or of metal printed on a substrate, to form the collector circuit 13 shown in FIG. 2 of the drawings, which comprises an inner circumferential conductor 15 and an outer circumferencial conductor 14, connected to each other at one of their ends by means of a conductor 16. Each one of the cables 9 and cable 11 are connected to the outer conductor 14 through the intermediate of unidirectional electronic valves diagramatically shown in FIG. 2 as dots 17, whereas cable 7 is connected directly to the attached end of conductor 15 as clearly shown in FIG. 2 of the drawings. A small coil 18 is located at each one of said cables 7, 9 and 11, within the body 1 of the device, that is, completely embedded within said body, at a place which is contiguous to the points wherein the cables 7, 9 and 11 extend outwardly of body 1, for a purpose to be explained hereinafter.

The details of the unidirectional electronic valves 17 and the coils 18 in relation to the circuits of the voltage regenerator built in accordance with the present invention is more clearly shown in FIG. 3 of the drawings, whereas the position of the conductors 14 and 15 is clearly shown in FIG. 2 of the drawings, said position being extremely important to accomplish the goals of the present invention as will be explained hereinafter.

Figure 3:
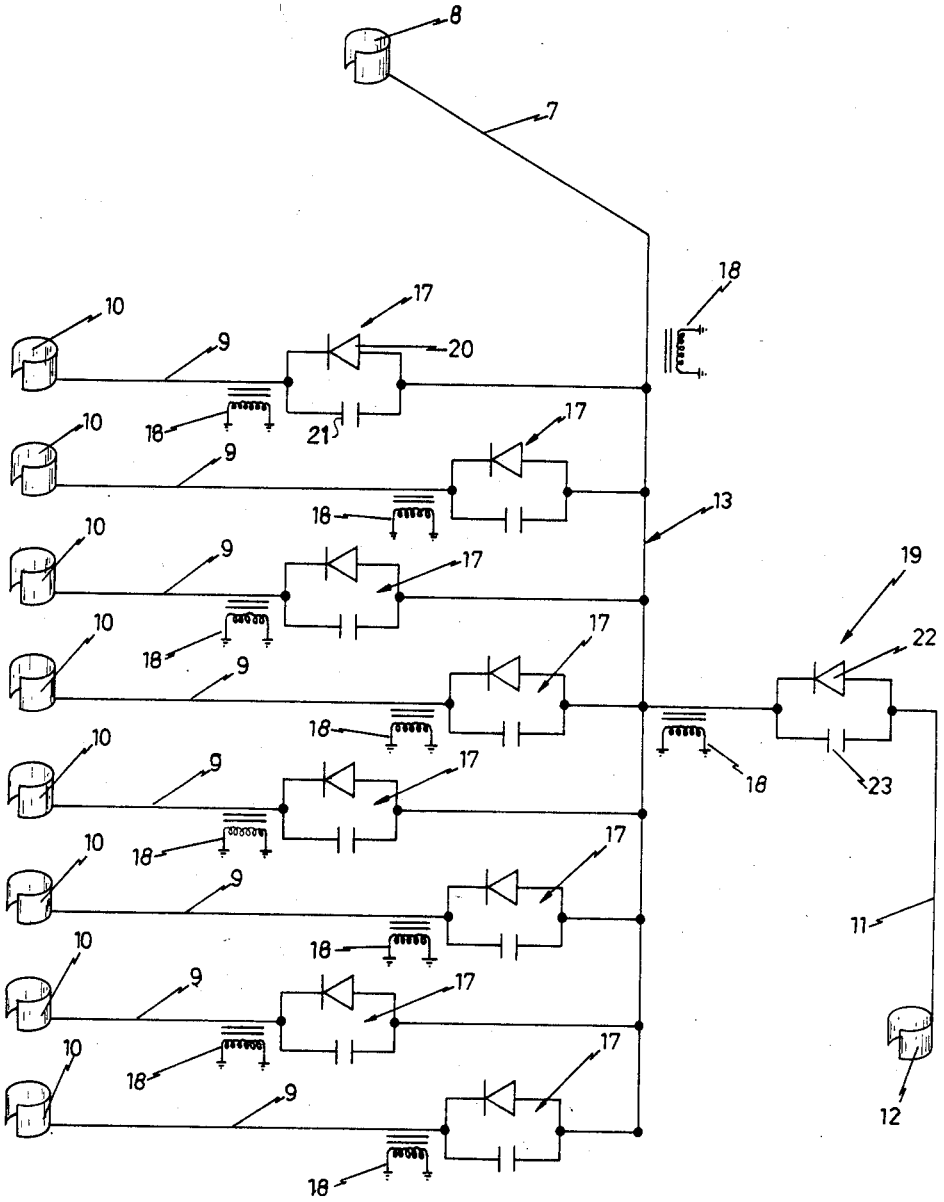
FIG. 3 is a circuit diagram showing the voltage regenerator circuit for ignition systems of internal combustion engines as applied to an engine containing 8 cylinders.

Although in FIGS. 1 and 2 of the drawings a voltage regenerator applicable to an internal combustion engine having four cylinders is shown, FIG. 3 shows, in a more detailed manner, a circuit built in accordance with the present invention as applied to an eight cylinder engine, and it must be pointed out that the voltage regenerator of the present invention may be applicable to any engine having any number of cylinders, by merely providing the necessary number of conductors 9 and clamps 10 as shown in the drawings.

Referring now more particularly to FIG. 3 of the drawings, a detailed explanation of the nature of the circuit included in the voltage regenerator built in accordance with the present invention, together with its relationship with the standard ignition system of an internal combustion engine containing eight cylinders will be given hereinbelow, under the understanding that the various parts of the standard ignition system of said internal combustion engine have not been shown in FIG. 3 of the drawings, since said systems are very well known and the insertion thereof in the figure would only complicate the same without gaining any useful purpose whatsoever. It is to be understood, however, that the voltage regenerator in accordance with the present invention is applied to an ignition system for an internal combustion engine containing any number of cylinders, which comprises a high-voltage coil which is connected by means of a suitable cable to a distributor, from which a plurality of cables extend to conduct the high-voltage current in sequence to each one of the spark plugs, through respective cables. The device of the present invention is externally applicable to said type of ignition system for an internal combustion engine without however modifying in any respect the structure and the arrangement of said ignition system whatsoever.

Referring now to FIG. 3 of the drawings, clamp 8 is crimped around the insulation of the high-voltage current conducting cable which connects the high-voltage coil to the distributor of the ignition system, at a position which is in the vicinity of the outlet contactor of said coil, preferably at a distance of from 1.5 to 4 cm from the end of the cable, and still more preferably at a distance of from about 2 to 2.5 cm therefrom, and once the clamp 8 has been duly pressed against the outside face of the insulation of said cable, the clamp is appropriately insulated by means of a suitable plastic or other insulating tape. The cable 7 conducts current which is normally lost through the insulation of said high-voltage current conducting cable of the ignition system, and delivers the same to the collector circuit 13 which is embedded in body 1 of the device of the present invention, without the need of any unidirectional electronic valve in cable 7, in view of the fact that normally the current which is lost at the outlet of the coil in the vicinity of which clamp 8 is arranged, is of such an intensity and high voltage that it does not require any such unidirectional electronic valve. On the other hand, the plurality of clamps 10 are connected, in exactly the same manner described above in connection with clamp 8, to each one of the cables leading from the head of the distributor to each one of the spark plugs of the cylinders of the internal combustion engine, and each one of said clamps 10 is crimped around the insulation of each one of said high-voltage current conducting cables from the distributor to the spark plugs, at a position which is at a short distance from the outlet contactors of the head of the distributor, preferably at the same distance described in connection with clamp 8. The cables 9 carry the current lost through the insulation of each one of said high-voltage current conducting cables towards the circuit 13, but in order to secure that all the current is conducted in the appropriate direction, an electronic unidirectional valve 17 is provided, which comprises a diode 20 and a condenser 21 connected in parallel in each one of the cables 9, as clearly shown in FIG. 3 of the drawings, so that the current coming from each one of clamps 10 and through cables 9, will charge the capacitor 21, until the voltage thereof reaches to an appropriate level to be discharged, which discharge is effected towards the circuit 13, in view of the fact that the diode 20 included therein does not permit the return of the current back through cable 9 into clamp 10. Each one of the cables leaving the distributor head to each one of the spark plugs contains an identical circuit, in order to secure the recovery of current lost through the insulation of said cables and its conduction through cables 9 and unidirectional valves 17 towards collector circuit 13.

Finally, cable 11 is connected to circuit 13 on one end and to clamp 12 on the other end, through the intermediate of an electronic unidirectional valve 19 similar to the valves 17 described above. In this particular instance, however, the condenser 23 is charged by means of the current accumulated in the collector circuit 13, until the voltage thereof is sufficient to be discharged, directed by the diode 22, through cable 11 towards clamp 12. Clamp 12 is crimped around cable 6 which connects the coil to the distributor head, at a position in the vicinity of the inlet of said distributor head, namely, at a distance similar to that described above in connection with cable 7.

The current conducted to clamp 12 is inductively transmitted again into the cable 6, whereby all the current lost in the different cables is recovered by the voltage regenerator of the present invention and is recycled to the distributor, with which the losses of voltage are minimized.

Going back to FIG. 2 of the drawings, it may be seen that the specific shape adopted by the collector circuit 13 is that of two concentrically arranged incomplete circumferential conductors 14 and 15 connected to each other at one end by means of a conductor 16, the incomplete circumferential conductor 14 containing the necessary taps for connecting all the external cables of the system as shown in FIG. 2 of the drawings, whereas the inner concentric incomplete circumferential conductor 15 is arranged near the inner surface of bore 5 of the body 1 of the device of the present invention, whereby the high-voltage current passing through cable 6 from the high-voltage coil to the distributor, acts as a suction device by the creation of magnetic fields which in a certain way attract the current from clamps 8 and 10, thereby boosting the passage of current from said clamps 8 and 10, through the respective cables 7 and 9 and the respective electronic valves 17, to be collected by means of circuit 13. From circuit 13, part of the collected current passes directly by induction from conductor 15 into cable 6 and the main part of said collected current passes through cable 11 as mentioned above, through the electronic valve 19, to be inductively discharged through clamp 12 into cable 6, at a position in the neighborhood of the distributor head.

Finally, in order to avoid the loss of important amounts of stray currents at the outlet of cables 7, 9 and 11 and from body 1 of the device of the present invention, a plurality of respective coils 18 are arranged, fully embedded in body 1, but located exactly at the point where each one of said cables extend outwardly of the body, which coils collect the current which would otherwise be lost in the form of corona discharges and the like, and returns the same to the cables through the insulation thereof in an inductive manner. The above completes the recovery system for the device of the present invention, and it may be seen that the voltage regenerator built in accordance with the present invention and as described above, will be capable of recycling most of the current which would otherwise be lost through magnetic fields, leakage and stray currents, outwardly of the insulation of the various high-voltage current conducting cables of an ignition system for internal combustion engines which current is fully recycled by the device of the present invention in order to preserve the voltage created by the high-voltage coil, and in order to improve the performance of an engine by the production of suitable strong spark discharges in the spark plugs, which cause a more full combustion of the fuel in the cylinders of the engine.

The improvement in the efficiency of combustion is such that, on many occasions, through an analysis of the exhaust gases of an engine provided with a device in accordance with the present invention, it may be seen that the mixture is rendered extremely rich, whereby it is normally necessary to throttle the main gasoline spray nozzle of the carburator, in order to admit lower amounts of gasoline into said carburator so as to preserve the efficiency of combustion with the device of the present invention which, therefore, may economize fuel at a minimum rate of about 10% of the fuel that would be consumed otherwise.

The operation of the device of the present invention as is follows. All the current trapped by the clamps 8 and 10, is conducted through the respective cables 7 and 11 to the outer conductor 14 of collector circuit 13 embedded in the body 1 of the device of the present invention, partly due to the high-voltage produced in cable 7, partly due to the charging and discharging of the capacitors 21 and the unidirectional conducting of current by diodes 20 of electronic valves 17 included in each one of cables 9, and partly because of the attraction exerted by the passage of high-voltage current through cable 6, which creates a magnetic attracting field on the inner conductor 15 of the collector circuit 13. The major part of the thus collected current in collector circuit 13, is conducted through cable 9 and clamp 10 and recycled to the distributor in an inductive manner as described above, by the action of the charging and discharging of capacitor 23 and the unidirectional conducting diode 22 included in the valve 19 of cable 11. One other part of said current collected in the collector circuit 13, is inductively passed into cable 6 around which the body 1 of the device of the present invention is mounted, and which passes through the bore 5 of said body 1, so that all the current collected by the collector circuit 13 is returned to cable 6, part of the same at a position in the neighborhood of the end of said cable 6 which enters into the head of the distributor, and one other part of which is inductively passed into cable 6, by means of the surrounding conductor 15 provided within the body 1 of the device.

Therefore, by the provision of the device of the present invention, which is installed on the standard ignition system of an internal combustion engine without any modification of said ignition system, a full recycling of the current lost through leakage and stray current and through magnetic fields created both at the head of the distributor and outwardly of the insulation of the corresponding cables described above, may be generated, with the consequent minimizing of the loss of voltage from the high-voltage coil to the spark plugs, wherein practically the full voltage produced by said coil is received.

The use of the device of the present invention, inter alia, produces the advantages, in view of the high recovery of the current otherwise wasted through leakage and stray currents and through magnetic fields, and because of the increase in the spark produced by the spark plugs, of providing the possibility of spacing the elctrodes of the spark plug at a larger distance, which strenghtens the spark and permits the gasoline entering the combustion chamber of the cylinder to be fully burned, thereby eliminating any carbonization and consequently increasing the life of the engine and of the spark plugs. Also, the use of the system of the present invention extends the duration of the high-voltage coil of the ignition system itself, because said coil will work at its minimum capacity, in view of the recovery of the current accomplished by the circuit of the present invention and the preservation of the voltage delivered to the spark plugs. By improving the ignition of the engine as a consequence of a better discharge of the spark, the electric start motor and the battery related to the engine will be required to only produce the minimum effort. Finally, the device of the present invention also provides a reduction in gasoline consumption, since the combustion accomplished is highly increased in its efficiency.

Although a specific embodiment of the present invention has been shown and described above, it is to be understood that many modifications thereof are possible. The present invention, therefore, is not to be restricted except insofar as is necessitated by the prior art and by the spirit of the appended claims.

What is claimed is:

1. A voltage regenerator for an ignition system of an internal combustion engine, said ignition system comprising a high-voltage coil, a current distributor connected to said high-voltage coil by means of a cable, and a plurality of spark plugs located within the cylinders of said internal combustion engine and connected with said distributor by means of respective cables, said voltage regenerator being useful for recovering the current lost through the formation of magnetic fields and leakage and stray currents on the cover of the distributor and on the insulation of said high-voltage current conducting cables from said high-voltage coil to said distributor and from said distributor to said plurality of spark plugs, and comprising inductive current trapping means for trapping the current lost through the insulation of said high-voltage current conducting cables, said current trapping means being coupled to said cables at a short distance from the current receiving ends thereof; encapsulated current collector means for receiving the current recovered by said current trapping means; at least some of said current trapping means including unidirectional current flow means permitting only the flow of current toward said collector means; current attracting means inductively coupled to said collector means; and inductive current delivery means for delivering the recovered current from said collector means to said high-voltage conducting cable running from the high-voltage coil to the distributor, said current delivery means being coupled to said cable at a short distance from the current discharge end thereof and including unidirectional current flow means permitting only the flow of current from said collector means to said last named cable.

2. A voltage regenerator according the claim 1 wherein said inductive current trapping means each comprises a clamp of a current conducting metal, crimped around and over the insulation of said high-voltage current conductive cables, a cover of an electrical insulating tape over the surface of said clamp, and an insulated cable attached to said clamp, to connect the same to said current collector means.

3. A voltage regenerator according to claim 1 wherein said inductive current delivery means comprises a clamp of a current conductive metal, crimped around and over the insulation of said high-voltage current conductive cable, a cover of an electrically insulating tape over the surface of said clamp, and an insulated cable attached to said clamp, to connect the same to said current collector means.

4. A voltage regenerator according to claim 1 wherein said encapsulated current collector means comprises a solid body of a temperature resistant material having a bore completely passing therethrough, said bore having a diameter suitable for mounting said body around the high-voltage current conducting cable from the high-voltage coil to the distributor, a pair of incomplete circumferential conductors concentrically arranged within said body and surrounding said bore, the inner one of said incomplete circumferential conductors being concentrically near the periphery of said bore and the outer one of said incomplete circumferential conductors being arranged concentrically to the inner one of said conductors, and being connected to each other at one of their ends by means of a further conductor, all of the insulated cables of said current trapping means and of said inductive current delivery means being connected to said outer incomplete circumferential conductor, with said current delivery means being connected at the end of said outer conductor remote from the end which is connected to said inner conductor by means of said further conductor, and with said current trapping means being connected to taps provided along the circumference of said outer conductor.

5. A voltage regenerator according to claim 4 wherein said high-voltage current conducting cable from the high-voltage coil to the distributor of the ignition system of the internal combustion engine passes within the bore of said solid body so that the current flow therein is perpendicular to the arrangement of said encapsulated current collector means, said inner incomplete circumferential conductor being arranged concentrically around said high-voltage current conducting cable, whereby the current running through said cable induces a magnetic field on said inner conductor, thus constituting said current attracting means for attracting the current towards said current collector means, at least part of the current collected in said current collector means passing by induction from said inner conductor into said high-voltage current conducting cable.

6. A voltage regenerator according to claim 4 wherein each one of said unidirectional current flow means is encapsulated within said solid body and each one comprises a diode and a condenser connected in parallel to said insulated cables, one end of which is connected to said current trapping means or to said current delivery means and the other end of which is connected to said current collector means, whereby as current is received by said condenser thus charging the same, the voltage of said condenser is increased until it is discharged through said diode in the direction of conduction of the same.

7. A voltage regenerator according to claim 4 wherein the insulated cables of each one of said current trapping means and of said current delivery means is inductive coupled with a coil embedded within said encapsulating solid body, said coil being placed in the neighborhood of each one of said cables, at a point within said encapsulating body which coincides with the exiting position of said cables from said encapsulating body, so as to recover any stray current that may tend to be lost outwardly of said cables and of said encapsulating body.

* * * * *